US005720652A

United States Patent [19]

Steinwender et al.

[11] Patent Number: 5,720,652

[45] Date of Patent: Feb. 24, 1998

[54] DEVICE FOR MICROFINISHING BOTH SIDES OF A WORKPIECE

[75] Inventors: Horst Steinwender, Remscheid; Georg Strätz, Bamberg, both of Germany

[73] Assignee: Supfina Grieshaber GmbH & Co., Remscheid, Germany

[21] Appl. No.: 629,037

[22] Filed: Apr. 8, 1996

[30] Foreign Application Priority Data

Apr. 8, 1995 [DE] Germany ..... 195 13 383.8

[51] Int. Cl.[6] ..... B24B 5/00; B24B 29/00

[52] U.S. Cl. ..... 451/254; 451/262; 451/271

[58] Field of Search ..... 451/262, 357, 451/63, 902, 270, 271, 254

[56] References Cited

U.S. PATENT DOCUMENTS

| | | | |
|---|---|---|---|
| 1,606,813 | 11/1926 | Schultz | 451/262 |
| 2,168,596 | 8/1939 | Hall | 451/262 |
| 2,417,737 | 3/1947 | Culp | 451/262 |
| 3,874,122 | 4/1975 | Ward | 451/262 |
| 4,478,008 | 10/1984 | Dunn | 451/262 |
| 4,524,547 | 6/1985 | Heaston et al. | 451/262 |
| 4,845,900 | 7/1989 | Suzuki et al. | 451/262 |
| 5,042,203 | 8/1991 | Kobayashi | 451/262 |
| 5,056,266 | 10/1991 | Norris | 451/262 |
| 5,353,553 | 10/1994 | Miller | 451/63 |
| 5,381,630 | 1/1995 | Kinner | 451/63 |
| 5,425,666 | 6/1995 | Frank et al. | 451/357 |
| 5,496,207 | 3/1996 | Hornung et al. | 451/357 |

FOREIGN PATENT DOCUMENTS

| | | |
|---|---|---|
| 3928113C1 | 1/1991 | Germany . |
| 4130653C2 | 4/1996 | Germany . |

*Primary Examiner*—James G. Smith
*Assistant Examiner*—Derris H. Banks
*Attorney, Agent, or Firm*—Jones, Tullar & Cooper, P.C.

[57] ABSTRACT

In a device for microfinishing both sides of disklike workpieces with plane and/or spherical surface, two tool spindles with two tools are provided on two orbit spindles; the two tools engage the two face-end surfaces of the workpiece. The tool spindles revolve, spaced apart by a certain distance, around the axes of the two orbit spindles. In this way, excellent micrographs and excellent grinding results are attained.

22 Claims, 2 Drawing Sheets

DEVICE FOR MICROFINISHING BOTH SIDES OF A WORKPIECE

FIELD OF THE INVENTION

The invention relates to a device for microfinishing or superfinishing both sides of disklike workpieces or workpiece surfaces with a plane and/or spherical surface.

BACKGROUND OF THE INVENTION

Such devices are known, for instance from EP 640 436 A1 or EP 640 437 A1. Both of these European Patent Disclosures pertain to an apparatus and a method for fine-grinding a ring of a brake disk; via an articulated holder, the tool can be adjusted relative to the surface to be machined.

OBJECT AND SUMMARY OF THE INVENTION

The object of the invention is to improve a device of the type referred to at the outset such that with it, disklike workpieces can be optimally machined on both sides simultaneously.

This object is attained in accordance with the invention in that it has means for receiving the workpiece, and is also provided with a first tool, rotatably received in a first tool spindle, for machining one surface of the workpiece, the first tool spindle being rotatably received in a first orbit spindle and the axis of the first tool spindle and the axis of the first orbit spindle being spaced apart by a first distance from one another, and with a second tool, rotatably received in a second tool spindle, for machining the other surface of the workpiece, the second tool spindle being rotatably received in a second orbit spindle and the axis of the second tool spindle and the axis of the second orbit spindle being spaced apart by a second distance from one another; and in the machining of the workpiece, both orbit spindles and both tool spindles are set into rotary motion.

The disklike workpiece surface is understood to mean end faces of bores, for instance, which are provided in a housing, such as a pump housing. Although the ensuing discussion refers throughout to disklike workpieces, this is not to be understood as limiting the invention.

With such a device, disklike workpieces can be machined simply and quickly. Moreover, the device of the invention causes minimal deformation of the workpiece, which is reflected in very close machining tolerances. With the device of the invention, various micrographs can be produced, and in particular cross grinding can be achieved.

In a further feature it is provided that the means for receiving the workpiece receive it on its peripheral faces. Preferably, the means for receiving the workpiece is a three-point or three-line bearing. Another embodiment provides that a collet chuck is used to retain the workpiece. The retaining means engages the workpiece on its peripheral surface, so that the face ends to be machined are freely accessible. Moreover, the workpiece is restrained via the retaining means against rotary motions, radial offset and the like. Outfitting the device of the invention and removing the workpiece can be done fully automatically, for instance via a revolver mount or a linearly movable mount.

In an especially preferred embodiment of the device of the invention, the rotary directions of all the spindles are the same. This has the advantage that inside the spindle drives, devices for reversing the direction of rotation can be dispensed with.

In other embodiments it is provided that the rotary directions of the first tool spindle and/or the first orbit spindle are not the same as the rotary directions of the second tool spindle and/or the second orbit spindle. By means of this feature, many different superfinishing methods can be performed.

Because the first tool and/or the second tool can be positioned from both sides of the workpiece, in particular hydraulically, pneumatically, or via a numerical control system, fully automatic operation is possible. Moreover, it is no problem to integrate the trigger drive with conventional machines.

Optimal work outcomes are attained in that the axes of the two tools are offset from one another by an angle other than 0°, and in particular by 90°. In this way, only one tool engages some segments of the workpiece, while both tools simultaneously engage other segments of the workpiece. Moreover, still other segments of the workpiece are not engaged by any of the tools, thus allowing these segments to be cleaned and/or cooled.

Advantageously, the axes of the tools orbit around the center point of the workpiece, particularly in a circle. Preferably, the angular offset of the two tools in the orbiting motion of the tools is constant about the center point of the workpiece. This accordingly maintains optimal machining conditions, in which a high cutting capacity, close tolerances, optimal surface quality, and so forth are attained.

One embodiment provides that the axes of the tool spindles are coupled mechanically or electronically. In the electronic coupling, there is moreover the capability of purposefully intervening in the course of the method, for instance at the initiation of in-process measuring devices. Moreover, the axes of the orbit spindles can be coupled to one another mechanically or electronically.

To adjust the cross-grinding and the planarity or spherical geometry, which may be concave or convex, the axis of the tool spindle forms an adjustable angle other than 0° with the axis of the orbit spindle. In this way, plane-parallel surfaces can be machined, or the workpiece can be provided with plane-parallel face ends, or one or two convexly or concavely curved end faces on the workpiece can be machined.

For adjusting the planarity or angle of the workpiece surfaces, the axes of the orbit spindles form an adjustable angle other than 0° in the horizontal and/or vertical plane.

Preferably, the tool is a cup grinding disk or a grinding ring. This has the advantage that the surface of the tool engaging the workpiece has a substantially constant spacing from the rotational axis of the tool spindle, compared with a grinding wheel resting with its entire surface on the workpiece.

Preferably, the axis of the first and/or second orbit spindle extends through the center point of the workpiece. In another embodiment, the orbit spindles are coaxial with one another, and they are spaced apart from the center point of the workpiece. As a result of this embodiment, still other variations in the finishing method are possible. An additional variation is attained in that the rotational speed of at least one of the spindles is variable.

Further advantages, characteristics and details of the invention will become apparent from the ensuing detailed description of the device of the invention, taken in conjunction with the drawings. The characteristics shown in the drawings and recited in the claims and mentioned in the specification may be essential to the invention either individually or in arbitrary combination with one another.

DESCRIPTION OF THE PREFERRED EMBODIMENTS

Figure 1:
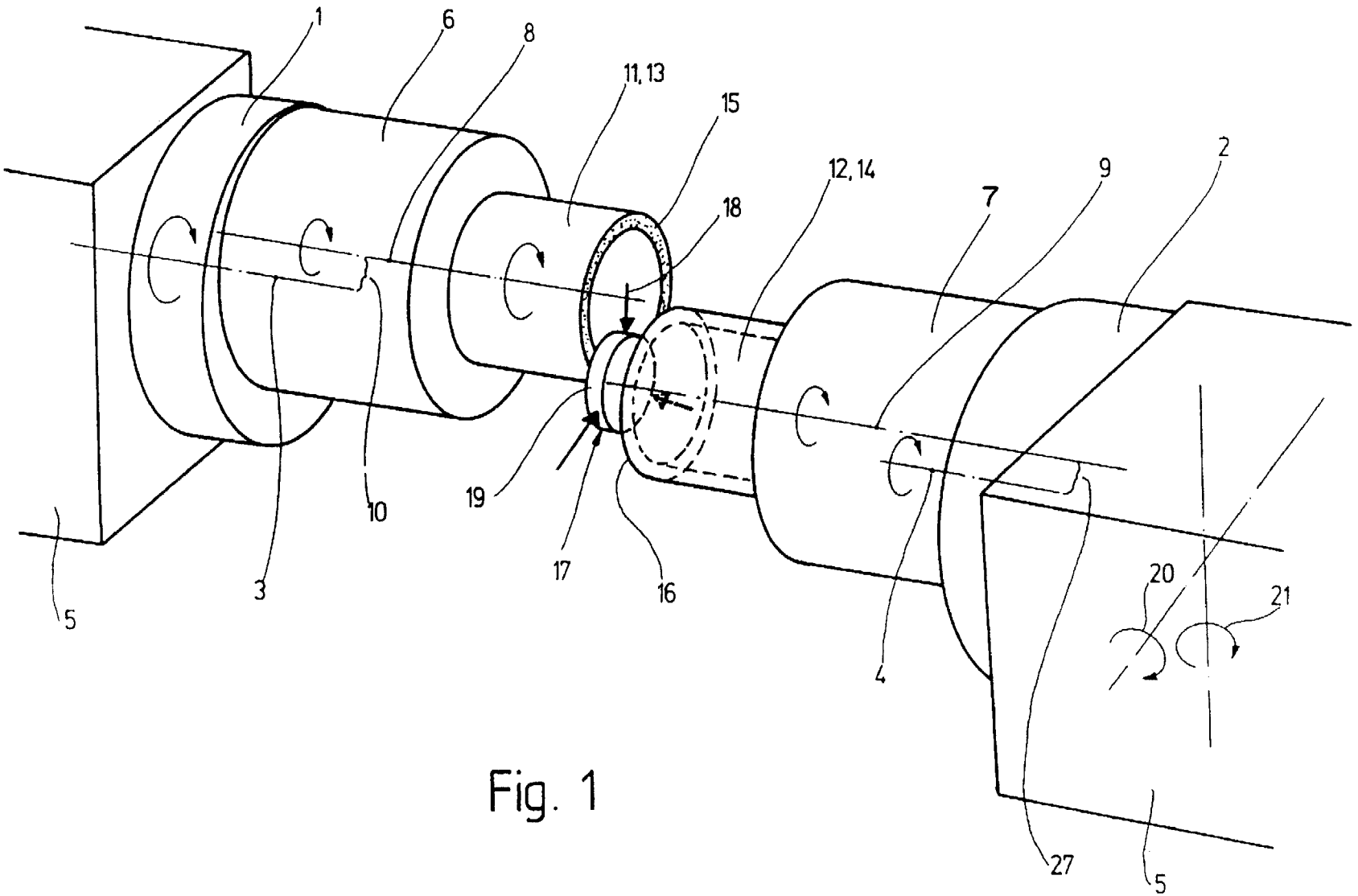
FIG. 1 is a perspective view of two orbit spindles with tool spindles, with a workpiece fastened between the tools.

FIG. 1 shows two orbit spindles 1 and 2 of a superfinishing machine not shown in further detail. These orbit spindles 1 and 2 have axes 3 and 4 about which they can rotate. The drive of the orbit spindles 1 and 2 is not shown and is located inside the housing 5.

Secured to the orbit spindles 1 and 2 are tool spindles 6 and 7, whose rotational axes 8 and 9 are each spaced apart by a respective distance 10 and 27 from the axes 3 and 4 of the orbit spindles 1 and 2. Coaxially with the axes 8 and 9, tools 11 and 12 are secured to the tool spindles 6 and 7. The orbit spindles 1 and 2, the tool spindles 6 and 7, and the tools 11 and 12 rotate in the direction of the arrows, in the form of parts of circles, drawn around the axes 3 and 4 and 8 and 9. The tools 11 and 12 are embodied as cup grinding disks 13 and 14.

A disklike workpiece 17 is located between the annular tool faces 15 and 16; it is held stationary on its peripheral edge 19 by a tool holder, represented merely by three arrows. This workpiece 17 has parallel end faces, which are machined plane-parallel by the two tools 11 and 12. However, the workpiece 17 may also be provided with one or two concavely or convexly curved face ends, which are machined via the two tools 11 and 12.

To assure plane-parallel machining of the two end faces of the workpiece 17, the two axes 3 and 4 of the orbit spindles 1 and 2 are angularly adjustable in the horizontal plane and in the vertical plane, in the direction of the arrows 20 and 21 or in the opposite direction therefrom.

To enable machining curved surfaces of the workpiece 17, or to enable adjusting the workpieces to these surfaces, the axis 8 of the first tool spindle 6 is angularly adjustable relative to the axis 3 of the first orbit spindle 1, and correspondingly the axis 9 of the second tool spindle 7 is angularly adjustable relative to the axis 4 of the second orbit spindle 2. The axes 3 and 8 can intersect one another or be skewed relative to one another, and the axes 4 and 9 can do likewise.

Figure 2:
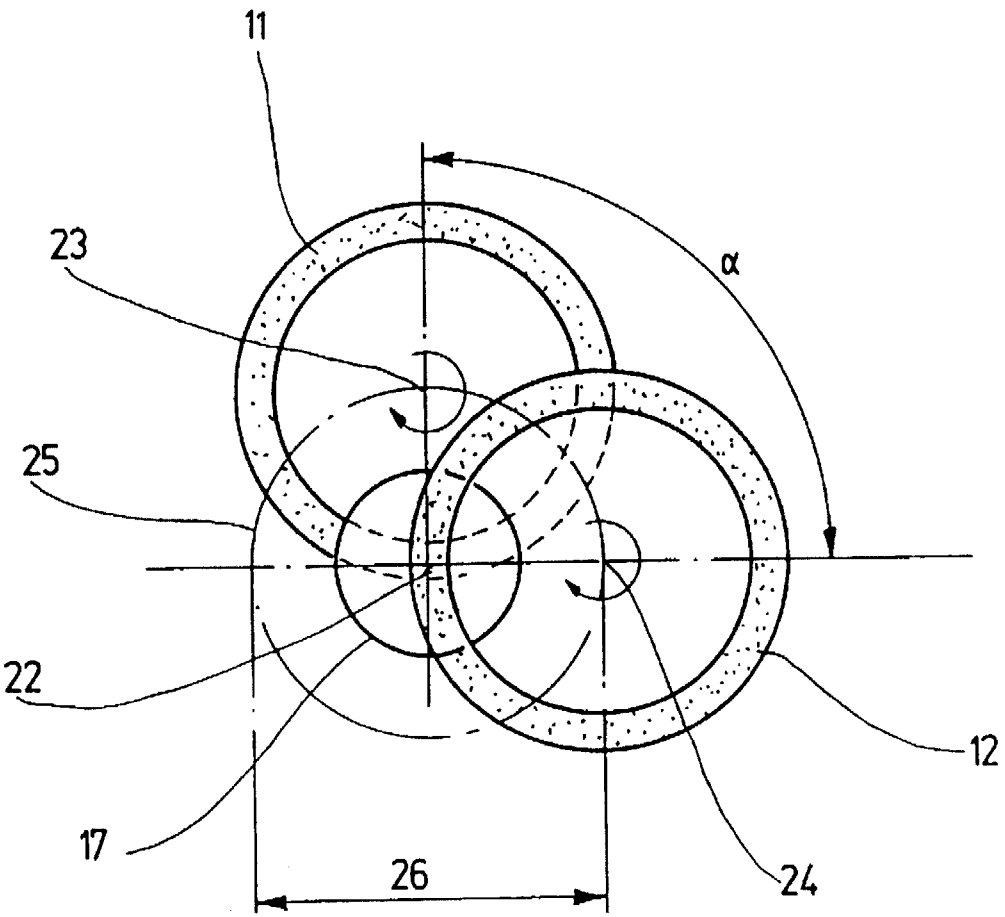
FIG. 2 is a view in the direction of the arrow II of FIG. 1, showing the workpiece and the two tools.

In FIG. 2, the two tools 11 and 12 and the workpiece 17 are shown. The center point of the workpiece 17 is marked 22. The axis 3 and 4 of the two orbit spindles 1 and 2 also pass through this center point 22. The two center points of the tools 11 and 12 are marked 23 and 24; the rotational axes 8 and 9 of the tool spindles 6 and 7 pass through these center points 23 and 24.

The rotational axes 8 and 9 of the tool spindles 6 and 7 and of the tools 11 and 12 move along a path of revolution 25, or circular orbit, which has a diameter 26. The diameter 26 is equivalent to approximately twice the distance 10 and 27, respectively, by which the axes 3 and 8 of the spindles 1 and 6 and the axes 4 and 9 of the spindles 2 and 7 are spaced apart.

It can also be seen in FIG. 2 that the two rotational axes 8 and 9 are angularly offset by an angle $\alpha$ of approximately 90°, and the rotational axis 9 of the second tool spindle 7 leads ahead of the rotational axis 8 of the first tool spindle 6.

The size of the tools 11 and 12 is chosen such that the region in which the two tools 11 and 12 simultaneously engage the two end faces of the workpiece 17 is located substantially in the vicinity of the center point 22. In this way, unilateral strains that could possibly cause deformation are averted.

We claim:

1. A device for microfinishing or superfinishing both sides of disklike workpieces each having a peripheral face and one of a plane, spherical and plane and spherical surfaces, comprising:

means for receiving a disklike workpiece with one of the surfaces noted along its peripheral face;

a first orbit spindle defining an axis of rotation, a first tool spindle rotatably received in said first orbit spindle, said first tool spindle defining an axis of rotation which is spaced apart from the axis of rotation of said first orbit spindle by a first distance, and a first tool rotatably received in said first tool spindle for machining one surface of the workpiece;

a second orbit spindle defining an axis of rotation, a second tool spindle rotatably received in said second orbit spindle, said second tool spindle defining an axis of rotation which is spaced apart from the axis of rotation of said second orbit spindle by a second distance, and a second tool rotatably received in said second tool spindle for machining the other surface of the workpiece; and means for rotating said first orbit spindle and said second orbit spindle.

2. The device as defined in claim 1, wherein said means for receiving a disklike workpiece comprises a three-point or three-line bearing.

3. The device as defined in claim 1, wherein said means for receiving a disklike workpiece comprises a collet chuck.

4. The device as defined in claim 1, wherein said means for receiving a disklike workpiece restrains the workpiece against rotary motion.

5. The device as defined in claim 1, wherein the direction of rotation of said orbit spindles and said tool spindles is the same.

6. The device as defined in claim 1, wherein the direction of rotation of said first orbit spindle and said first tool spindle is different from the direction of rotation of said second orbit spindle and said second tool spindle.

7. The device as defined in claim 1, wherein at least one of said first tool, said second tool and said first and second tool is positioned relative to the workpiece by one of a hydraulic system, a pneumatic system and a numerical control system.

8. The device as defined in claim 1, wherein the axes of rotation of said first and second tool spindles are offset from one another by an angle other than 0°.

9. The device as defined in claim 1, wherein the axes of rotation of said first and second tool spindles are offset from one another by an angle of 90°.

10. The device as defined in claim 1, wherein the axes of rotation of said first and second tool spindles are coupled mechanically.

11. The device as defined in claim 1, wherein the axes of rotation of said first and second tool spindles are coupled electronically.

12. The device as defined in claim 1, wherein the axis of rotation of each tool spindle forms an adjustable angle other than 0° with the axis of rotation of its associated orbit spindle.

13. The device as defined in claim 1, wherein the axes of rotation of said orbit spindles form an adjustable angle other than 0° in at least one of the horizontal, the vertical, and the horizontal and vertical planes.

14. The device as defined in claim 1, wherein said first tool comprises one of a cup grinding disk and a grinding ring.

15. The device as defined in claim 1, wherein said second tool comprises one of a cup grinding disk and a grinding ring.

16. The device as defined in claim 1, wherein said first and second orbit spindles are coaxial with one another.

17. The device as defined in claim 1, wherein the rotational speed of at least one of said spindles is variable.

18. A device for microfinishing or superfinishing both sides of disklike workpieces each having one of a plane, spherical and plane and spherical surfaces, and each defining a center point, comprising:

means for receiving a disklike workpiece with one of the surfaces noted;

a first orbit spindle defining an axis of rotation, a first tool spindle rotatably received in said first orbit spindle, said first tool spindle defining an axis of rotation which is spaced apart from the axis of rotation of said first orbit spindle by a first distance, and a first tool rotatably received in said first tool spindle for machining one surface of the workpiece;

a second orbit spindle defining an axis of rotation, a second tool spindle rotatably received in said second orbit spindle, said second tool spindle an axis of rotation which is spaced apart from the axis of rotation of said second orbit spindle by a second distance, and a second tool rotatably received in said second tool spindle for machining the other surface of the workpiece; and means for rotating said first orbit spindle and said second orbit spindle, wherein the axes of said first tool and said second tool orbit around the center point of the workpiece.

19. The device as defined in claim 18, wherein the orbit around the center point of the workpiece is circular.

20. The device as defined in claim 18, wherein the axes of rotation of said first and second tool spindles are offset from one another by an angle other than 0°, and wherein the angular offset of said first and second tools in the orbiting motion of said first and second tools is constant about the center point of the workpiece.

21. The device as defined in claim 18, wherein the axes of rotation of said first and second tool spindles are offset from one another by an angle of 90°, and wherein the angular offset of said first and second tools in the orbiting motion of said first and second tools is constant about the center point of the workpiece.

22. The device as defined in claim 18, wherein the axis of rotation of at least one of said first orbit spindle and said second orbit spindle extends through the center point of the workpiece.

* * * * *